US006314587B1

(12) United States Patent
Fang

(10) Patent No.: US 6,314,587 B1
(45) Date of Patent: Nov. 13, 2001

(54) RING BAND ADJUSTMENT STRUCTURE OF CRASH HELMET

(76) Inventor: Kuo-Yun Fang, 8F, No. 306, Sec. 6, Min Chuan E. Rd., Neihu District, Taipei (TW)

( * ) Notice: Subject to any disclaimer, the term of this patent is extended or adjusted under 35 U.S.C. 154(b) by 0 days.

(21) Appl. No.: 09/838,246

(22) Filed: Apr. 20, 2001

(30) Foreign Application Priority Data

Sep. 27, 2000 (TW) ..... 89216749 U

(51) Int. Cl.[7] ..... A42B 1/22
(52) U.S. Cl. ..... 2/418; 2/183
(58) Field of Search ..... 2/417, 418, 419, 2/420, 183, DIG. 11; 24/68 B, 274 WB

(56) References Cited

U.S. PATENT DOCUMENTS 6,219,851 * 4/2001 Fang ..... 2/418

* cited by examiner

*Primary Examiner*—Rodney M. Lindsey
(74) *Attorney, Agent, or Firm*—Rosenberg, Klein & Lee

(57) ABSTRACT

A ring band adjustment structure of a crash helmet comprises a ring band, a connection sheet, a locating bar, and a pair of locating adjusters. Two ends of the ring band are connected to the locating adjusters. The locating adjusters are connected to the locating bar so that the locating adjusters can move along a guide track formed at the edge of the locating bar. By pressing a press element on the locating adjuster, a point-shaped unidirectional locating element on the bottom face of the locating adjuster will leave from a corresponding strip-shaped unidirectional locating element on the locating bar, and the locating adjuster can move. Each end of the locating bar has a limit element so that the locating adjuster will not slide out. Thereby, the diameter of the ring band can be adjusted, the structure is simplifier, and the manufacture and assembly are easier, hence facilitating modular processing.

13 Claims, 8 Drawing Sheets

RING BAND ADJUSTMENT STRUCTURE OF CRASH HELMET

FIELD OF THE INVENTION

The present invention relates to a ring band adjustment structure of a crash helmet and, more particularly, to a locating structure, whereby the diameter of a ring band can be appropriately adjusted according to the head size of a user.

BACKGROUND ODF THE INVENTION

It is necessary to wear a crash helmet when riding a bicycle or a motorcycle. A ring band is provided in the crash helmet to be located and matched at the brow of a user. If the ring band is not an adjustable structure, it cannot apply to people having different sizes of heads. An adjustable ring band has been proposed, which has a connection seat and a cover body connected to two ends of the ring band. Although it has a hidden adjustment structure, because the connection seat needs to be fixedly joined with the cover body, a joining structure between them must be provided. Because the cover body is used to cover the connection seat, the main body of the connection seat and the main body of the cover body must have the same size. Therefore, some material is wasted. Moreover, the two ends of the ring band are locked at connection posts of an adjustment seat of the connection seat via through holes. The fixing effect of this kind of joining is not good so that other processing procedures must be matched, e.g., riveting the connection posts at the ring band. Therefore, the production cost is increased, and the manufacturing and assembling time is also increased. Additionally, the locating of a prior art adjuster can only be controlled by sense, resulting in inconvenient use. The present invention aims to resolve the above problems in the prior art.

SUMMARY OF THE INVENTION

An object of the present invention is to provide a ring band adjustment structure of a crash helmet, whereby two ends of the ring band can be easily joined with a locating adjuster, and the shifting and locating process of the locating adjuster is clearly visible so that adjustment can be performed in visual way. Moreover, because the two ends of the ring band are made of resilient locking structure, the assembling speed of the ring band with the locating adjuster will be faster. It is not necessary to use other auxiliary means, and the assembling and locating are more accurate. More importantly, the locating adjuster can be limited to only move within a certain range. Tail ends of a locating bar are used to limit distal ends of motion of the locating adjuster. The locating adjuster is joined with the locating bar in straddle way so that the locating adjuster can slide on the locating bar for locating. The required elements are more compact, and the adjustment is more convenient.

To achieve the above object, two ends of a ring band are connected to a locating adjuster, respectively. The locating adjuster is connected to a locating bar so that the locating adjuster can move along a guide track formed at the edge of the locating bar. By pressing a press element on the locating adjuster to let a point-shaped unidirectional locating element on the bottom face of the locating adjuster leave from a corresponding strip-shaped unidirectional locating element on the locating bar, the locating adjuster can be moved. Two ends of the locating bar have limit elements, respectively, so that the locating adjuster will not slide out. Thereby, the diameter of the ring band can be adjusted, and the production cost can be reduced. Moreover, the structure is simplifier and the manufacture and assembly are easier, hence facilitating modular processing.

The various objects and advantages of the present invention will be more readily understood from the following detailed description when read in conjunction with the appended drawing, in which:

DETAILED DESCRIPTION OF THE PREFERRED EMBODIMENTS

Figure 1:
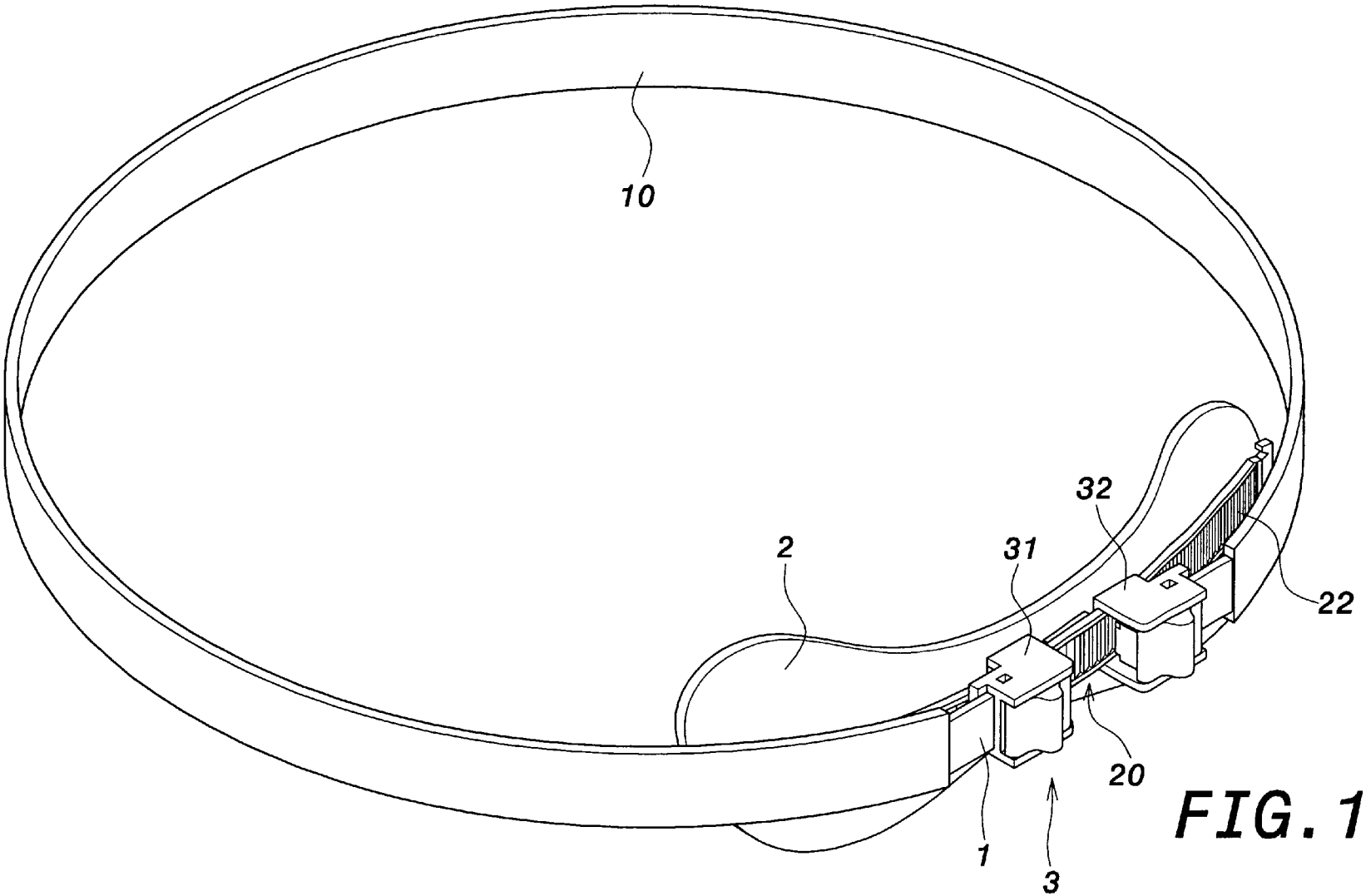
FIG. 1 is a perspective view of the present invention.

As shown in FIGS. 1 to 8, a ring band adjustment structure of the present invention comprises a ring band 1, a connection sheet 2, a locating bar 20, and a locating adjuster set 3. The ring band 1 is made of flexible material. The ring band 1 is a band of predetermined length and can be bent to form a ring. The ring band 1 can be sheathed by a soft sheathing body 10 to enhance comfort of wearing. The connection sheet 2 is a sheet of panel shape for connecting two ends of the ring band 1. The connection sheet 2 can be an arc body to assume a lying 8-shaped form so as to facilitate holding and to abut its set position. The locating adjuster set 3 is composed of a pair of locating adjusters, respectively being a left locating adjuster 31 and a right locating adjuster 32.

Similarly, the locating bar 20 is formed by joining a left locating bar 21 and a right locating bar 22 together. The side cross-sectional profile of the locating bar 20 forms a lying T-shaped form. The inner face of the locating bar 20 and the surface of the connection sheet 2 have guide slits 23 and 24 in between, respectively being a left guide slit 23 and a right guide slit 24, which are separated by a separating plate 29. The right guide slit 24 is at the right side of the separating block 29, the left guide slit 23 is at the left side thereof. An upper left guide 231 slit is at the upper left side of the separating block 29, a lower left guide slit 232 is at the lower left side thereof, an upper right guide slit 241 is at the upper right side thereof, and a lower right guide slit 242 is at the lower right thereof.

Figure 2:
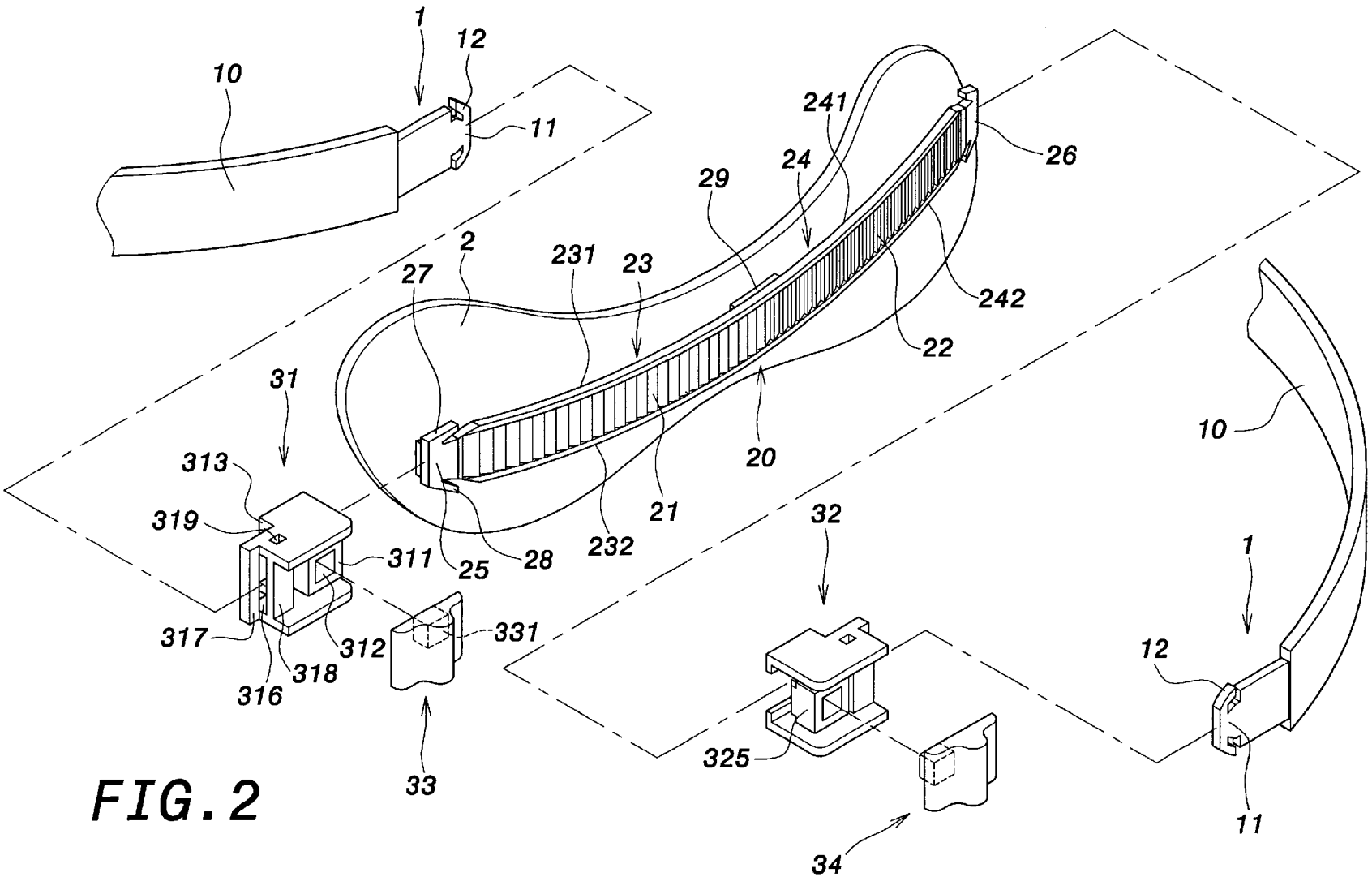
FIG. 2 is an exploded perspective view of the present invention.
Figure 5:
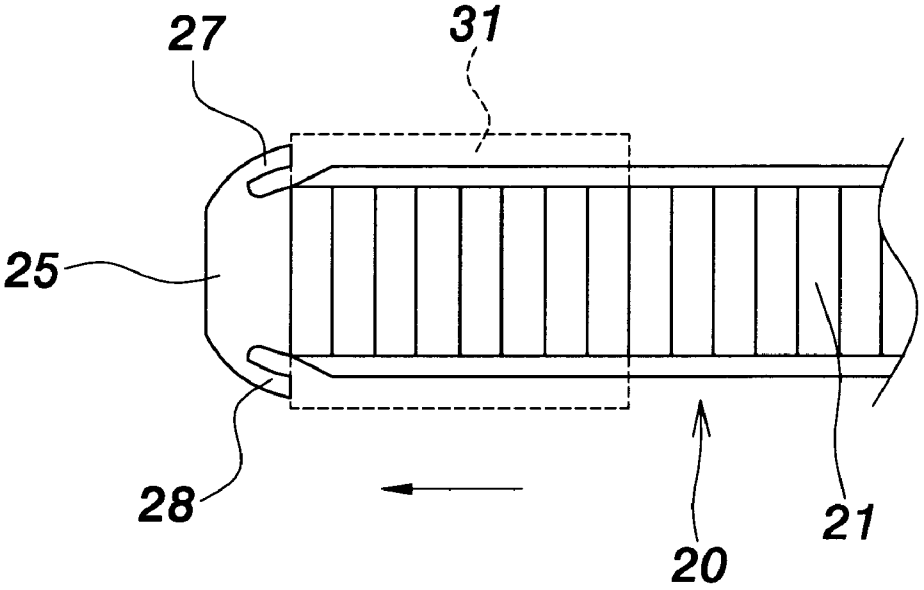
FIG. 5 is a view showing the relationship between a distal end of a locating bar and a locating adjuster of the present invention.

Each tail end of the locating bar 20 forms a limit element. As shown in FIG. 2, the limit element comprises a left anchor end 25 and a right anchor end 26 to let the left locating adjuster 31 and the right locating adjuster 32 respectively penetrate into the two ends of the locating bar 20. As shown in FIG. 5, the locating bar 20 uses limit elements provided at the tail ends thereof (the anchor ends 25 and 26) to let the locating adjusters 31 and 32 not slide out. The anchor end 25 or 26 is anchor-shaped. That is, the distal ends of the locating bar 20 forms two wing-shaped projective parts 27 and 28, which have a larger width than that of the locating bar 20. When the corresponding adjusters are locked at the locating bar 20, only the locating adjusters can be allowed to penetrate thereinto, and the two wing-shaped projective parts 27 and 28 of the anchor ends 25 and 26 can let the locating adjusters 31 and 32 not slide out, respectively.

The outer face of the locating bar 20 has point-shaped unidirectional locating elements corresponding to the locating adjusters, respectively. The strip-shaped unidirectional locating element on the locating bar is a ratchet bar, and the locating bar is divided into two symmetrically arranged halves, respectively being a left locating bar 21 and a right locating bar 22, each having a strip-shaped unidirectional locating element. The two strip-shaped unidirectional locating elements on the two half locating bars are arranged opposed to each other. In other words, the left locating bar 21 has a left ratchet bar, and the right locating bar 22 has a right ratchet bar. Because the ratchet is used here, a unidirectional fixing structure is formed, and quick slide motion will be generated in the other direction. The teeth of the ratchet bar are formed at the front end face of the locating bar.

Figure 4:
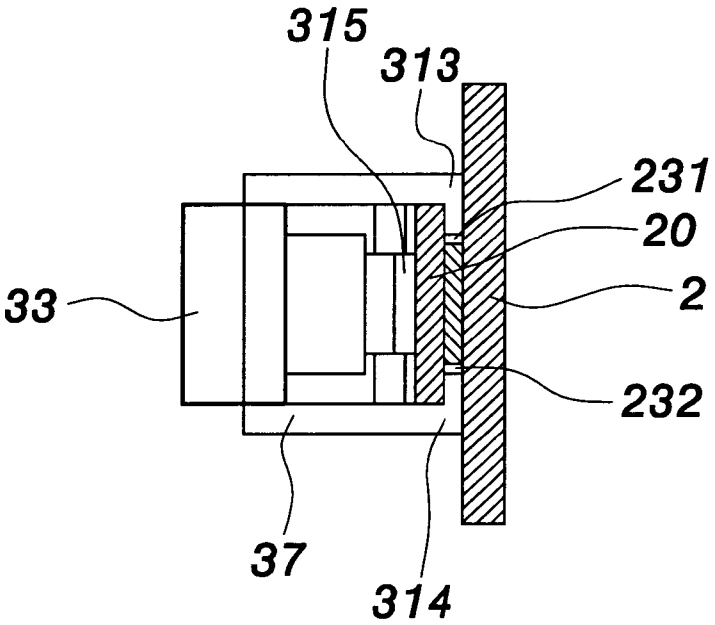
FIG. 4 is a cross-sectional view along the line 4—4 shown in FIG. 3 of the present invention.

Each of the locating adjusters 31 and 32 is formed of a locking body. Because the locating adjuster can be disposed at each of the two ends of the locating bar, it is only necessary to turn the locating adjuster 180 degrees to let the locating adjuster used at one side end to be used at the other side end. For instance, the left locating adjuster 31 has an upper L-shaped lock 313 and a lower L-shaped lock 314 respectively extending inwards from the top and bottom thereof to be embedded in the left guide slit 23. Thereby, the upper L-shaped lock 313 is locked in the upper left guide slit 231 above the locating bar 20, and the lower L-shaped lock 314 is locked in the lower left guide slit 232 below the locating bar 20. Therefore, the locking body of the locating adjuster can be locked on the locating bar 20 through the pair of L-shaped locks, as shown in FIG. 4.

Figure 6:
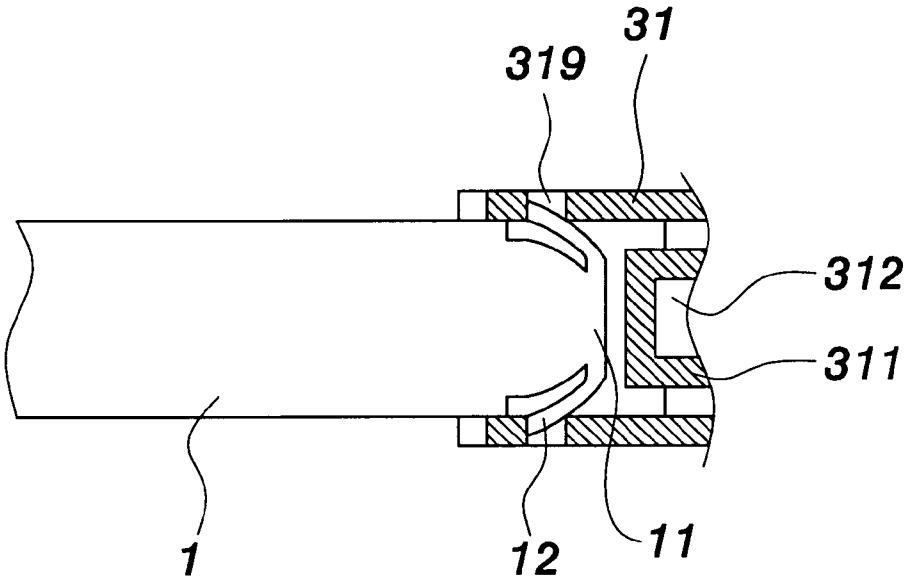
FIG. 6 is a cross-sectional view of the jointed state of distal ends of a ring band and a locating adjuster of the present invention.

The locking body of each of the locating adjusters 31 and 32 has a through groove 316 formed on the side face thereof. The through groove 316 is sandwiched between a rear clamping plate 317 and a front clamping plate 318. The locking body has a cavity 319 on each side face thereof at the position of the through groove 316 to lock one end of the ring band 1. One end of the ring band 1 forms an anchor end 11 similar to the anchor end of the locating bar 20. As shown in FIG. 6, the anchor end 11 has a pair of embedded locating ends 12 having a larger width than that of the ring band 1. The embedded locating end 12 is arrow-shaped. After the embedded locating end 12 penetrates into the through hole 316 of the locking body, two locking ends 12 thereof are embedded in the cavity 319 for locating to let each end of the ring band 1 join the locating adjuster 31 or 32 to be located. The locating adjusters 31 and 32 are locked on the locating bar 20 so that the locating adjuster set 3 can move forwards and backwards along the guide slits 23 and 24 formed by the locating bar 20.

The outer sides of the locating adjusters 31 and 32 join press elements 33 and 34, respectively. By pressing the press elements 33 and 34 to let point-shaped unidirectional elements 315 and 325 provided on the bottom faces of the locating adjusters leave from the corresponding strip-shaped unidirectional locating elements on the left and the right locating bars 21 and 22 of the locating bar 20. The strip-shaped unidirectional locating element shown in the figure is a ratchet bar, and the point-shaped unidirectional locating element 315 or 325 is a ratchet having at least a single tooth. The single tooth is also ratchet-shaped so that the ratchet can move on the ratchet bar.

Figure 3:
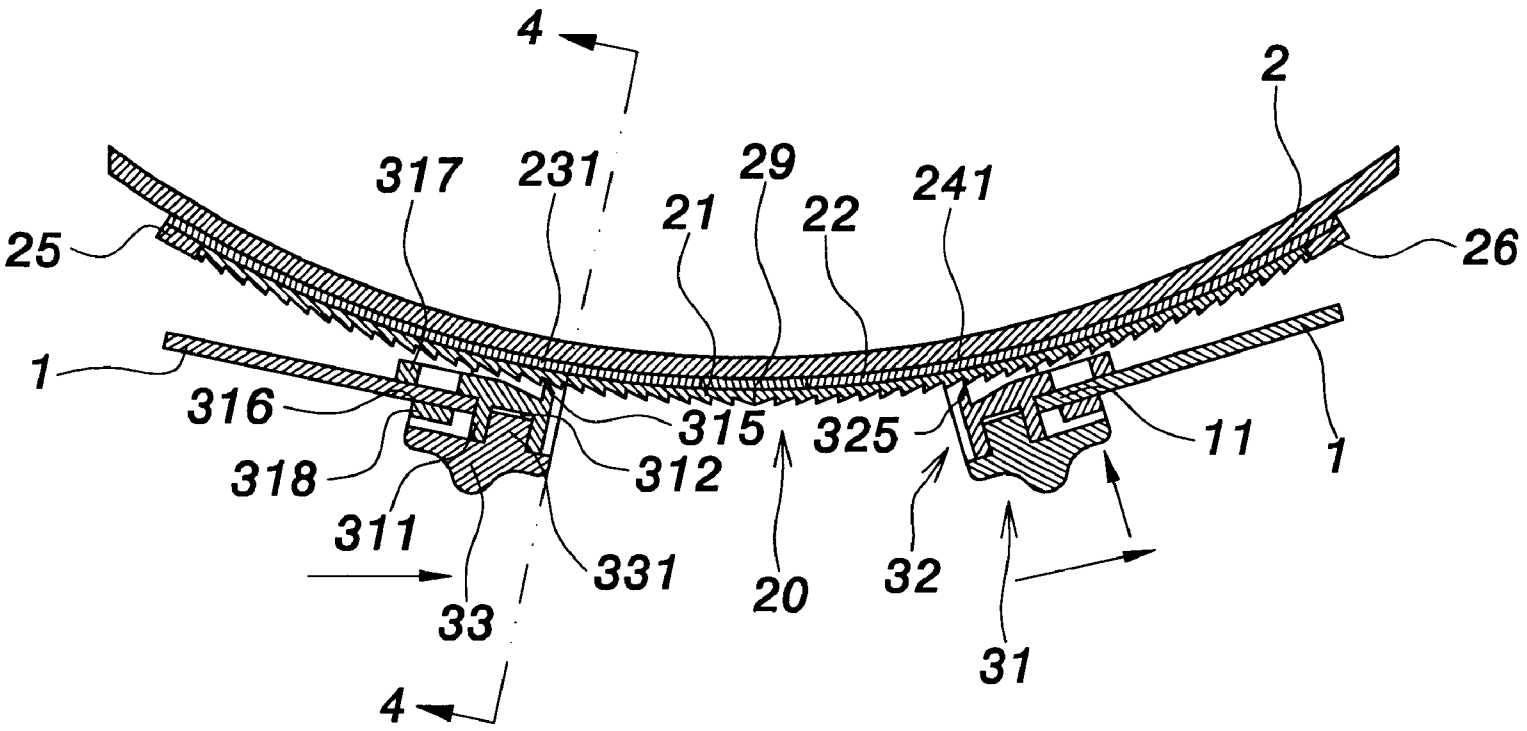
FIG. 3 is a transverse cross-sectional view of the present invention.

The characteristic of a ratchet is to generate unidirectional fixing. When pressing one end of the press element 33 and 34 near the ring band 1, the ratchet (point-shaped unidirectional locating element) will be pulled upwards to leave from the position for locking the ratchet bar (strip-shaped unidirectional locating element) so that each of the locating adjusters can move freely. The state of action is shown in FIG. 3. When not pressing the press elements 33 and 34, the point-shaped unidirectional locating element of each of the locating adjusters 31 and 32 will be located on the corresponding strip-shaped unidirectional locating element so that the ring band cannot move, but the locating adjusters can move toward each other. i.e., toward the direction of shrinking the diameter of the ring band 1. In other words, the locating adjusters 31 and 32 are allowed to only move unidirectionally toward the separating block 29 so as to shrink the ring band for locating.

Contrarily, to release the locating state, it is necessary to press the outer end of the press element (the opposite position of the point-shaped unidirectional locating element) to let the ratchet (point-shaped unidirectional locating element) cancel the unidirectional limiting effect for the ratchet bar (strip-shaped unidirectional locating element) so that the locating adjusters can move away from each other so as to enlarge the diameter of the ring band. Each of the press elements 33 and 34 has a locking block 331. The locking block 331 is embedded in a groove 312 of a bump 311 of the locking body and is led to move by the press elements 33 and 34 to let the locating adjusters 31 and 32 move together.

Figure 7:
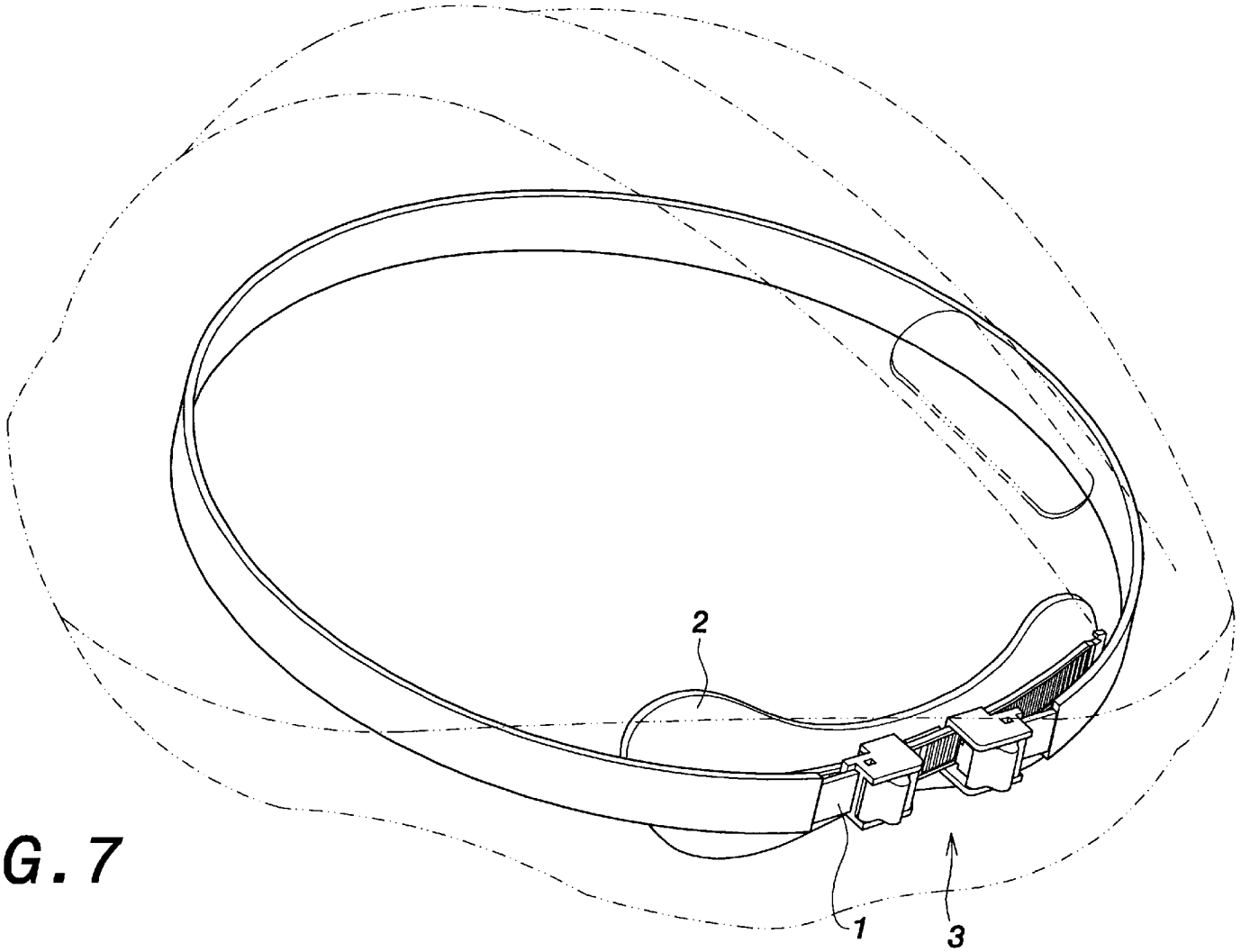
FIG. 7 is a perspective view showing a use state when disposed in a bicycle crash helmet of the present invention.
Figure 8:
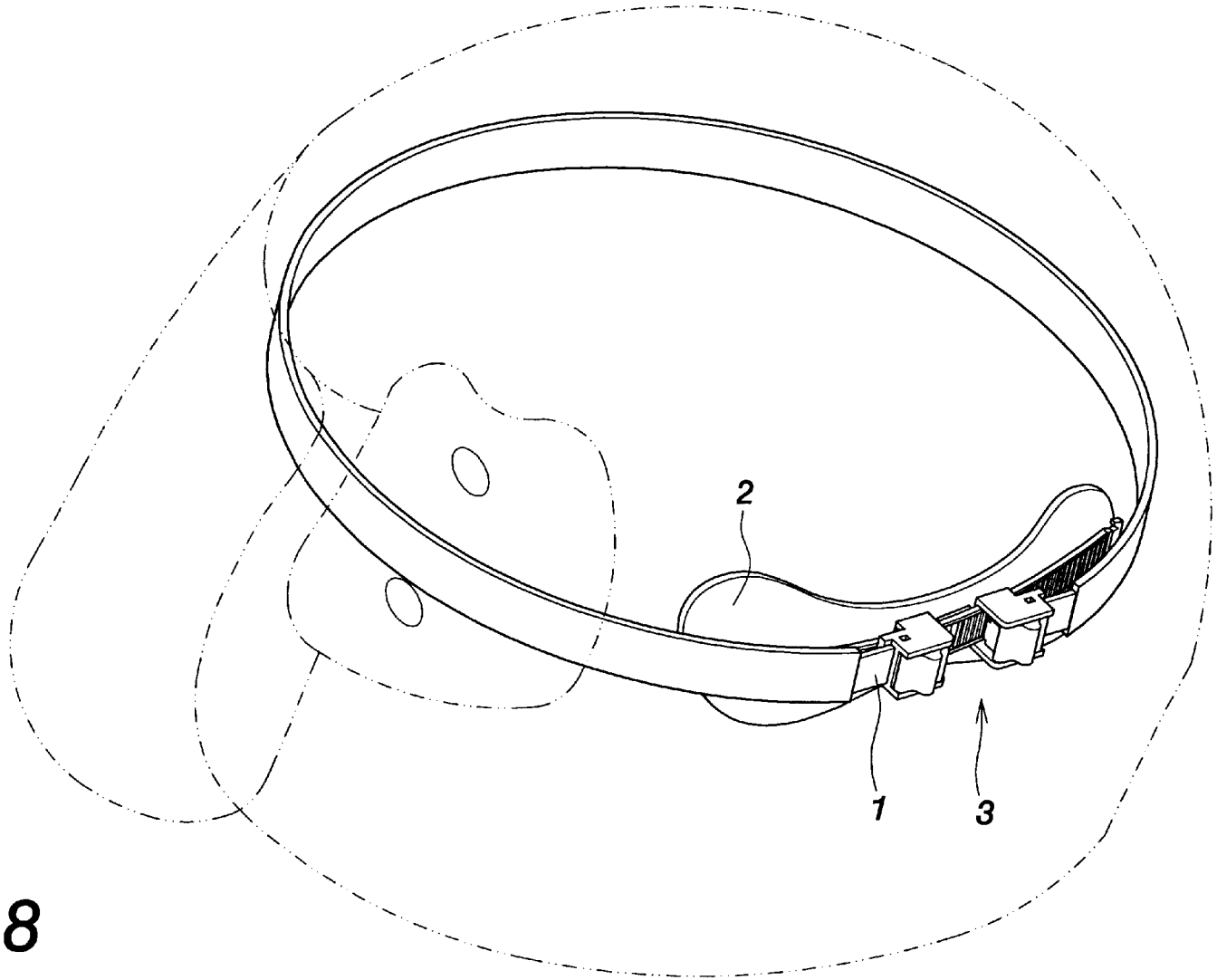
FIG. 8 is a perspective view showing a use state when disposed in a motorcycle crash helmet of the present invention.

Thereby, the diameter of the ring band can be adjusted freely, and the production cost can be reduced. Moreover, the structure is simplifier and the manufacture and assembly are easier, hence facilitating modular processing. FIG. 7 shows the situation that the present invention is joined in a bicycle crash helmet, and FIG. 8 shows the situation that the present invention is joined in a motorcycle crash helmet.

To sum up, the present invention uses locating adjusters respectively joined at two ends of a ring band and straddled on two half locating bars fixed on a connection sheet to let the ring band move on the locating bar along with the locating adjusters. Thereby, the diameter of the ring band can be adjuster freely. The adjustment is easy, and can be performed in visual way, hence being more accurate. As compared to the prior art, components and assembly time can be saved. The production cost is also reduced. Moreover, the structure is simplifier, and the manufacture and assembly are easier.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A ring band adjustment structure of a crash helmet, comprising:

a ring band;

a connection sheet of panel-shaped sheet;

a locating bar joined on said connection sheet and divided into two symmetrically arranged halves, outer faces of said two half locating bars respectively having strip-shaped unidirectional locating elements, which are arranged opposed to each other, a guide slit being respectively disposed above and below between said locating bar and said connection sheet; and two locating adjusters each connected to one end of said ring band, a top side and a bottom side of said locating adjuster extending rearwards to form a pair of L-shaped locks, said pair of L-shaped locks being embedded in said guide slits of said locating bar to let said locating adjuster straddle said locating bar and move along the edge of said locating bar, said locating bar having a press element, a back face of said locating adjuster toward said locating bar having a point-shaped unidirectional locating element, said point-shaped unidirectional locating element being locked at said strip-shaped unidirectional locating element on said locating bar;

whereby when pressing said press element, said point-shaped unidirectional locating elements will leave from said corresponding strip-shaped unidirectional locating elements on said locating bar, and the diameter of said ring band can be adjusted through the sliding of said locating adjuster.

2. The ring band adjustment structure of a crash helmet as claimed in claim 1, wherein said ring band can be sheathed by a soft sheathing body.

3. The ring band adjustment structure of a crash helmet as claimed in claim 1, wherein said ring band can be bent to form a ring shape.

4. The ring band adjustment structure of a crash helmet as claimed in claim 1, wherein each end of said ring band has an anchor end to be embedded in said locating adjuster.

5. The ring band adjustment structure of a crash helmet as claimed in claim 1, wherein said locating adjuster has a pair of cavities to join the anchor ends of said ring band.

6. The ring band adjustment structure of a crash helmet as claimed in claim 1, wherein said connection sheet is arc-shaped.

7. The ring band adjustment structure of a crash helmet as claimed in claim 1, wherein said strip-shaped unidirectional locating element on said locating bar is a ratchet bar.

8. The ring band adjustment structure of a crash helmet as claimed in claim 1, wherein each end of said locating bar has a limit element to prevent said locating adjuster from sliding out.

9. The ring band adjustment structure of a crash helmet as claimed in claim 8, wherein the limit element of said locating bar is an anchor end.

10. The ring band adjustment structure of a crash helmet as claimed in claim 1, wherein said point-shaped unidirectional locating element on said locating adjuster is a ratchet having at least a single tooth.

11. The ring band adjustment structure of a crash helmet as claimed in claim 1, wherein said locating adjuster has a through groove to be penetrated into by said ring band for fixing.

12. The ring band adjustment structure of a crash helmet as claimed in claim 1, wherein said press element of said locating adjuster is block-shaped, an inner side face of said press element having a projective locking block to be joined on said locating adjuster.

13. The ring band adjustment structure of a crash helmet as claimed in claim 12, wherein said locating adjuster has a bump, said bump having a groove so that the locking block of said press element can be embedded therein.

* * * * *